US008399754B2

(12) United States Patent
Koks

(10) Patent No.: US 8,399,754 B2
(45) Date of Patent: Mar. 19, 2013

(54) MUSICAL INSTRUMENT WITH A HEAD TENSIONED OVER A SHELL BY A RIM USING AN AXIALLY ORIENTED GRAIN STRUCTURE

(76) Inventor: Barry Dean Koks, Winnipeg (CA)

( * ) Notice: Subject to any disclaimer, the term of this patent is extended or adjusted under 35 U.S.C. 154(b) by 0 days.

(21) Appl. No.: 13/415,932

(22) Filed: Mar. 9, 2012

(65) Prior Publication Data

US 2012/0227569 A1 Sep. 13, 2012

Related U.S. Application Data

(60) Provisional application No. 61/451,318, filed on Mar. 10, 2011, provisional application No. 61/510,241, filed on Jul. 21, 2011.

(51) Int. Cl.
*G10D 13/02* (2006.01)

(52) U.S. Cl. ..... 84/411 R

(58) Field of Classification Search ..... 84/411 R, 84/421

See application file for complete search history.

(56) References Cited

U.S. PATENT DOCUMENTS

| | | | | |
|---|---|---|---|---|
| 2,301,519 | A | 11/1942 | Burhans | |
| 4,714,002 | A | 12/1987 | Cleland | |
| 6,916,977 | B2 | 7/2005 | Hagiwara | |
| 7,462,770 | B2 | 12/2008 | Dunnett | |
| 7,910,817 | B1 | 3/2011 | Huang | |
| 2007/0193432 | A1 | 8/2007 | Dunnett | |
| 2008/0041215 | A1 | 2/2008 | Wang | |
| 2008/0271588 | A1 * | 11/2008 | van der Meulen | 84/411 R |

FOREIGN PATENT DOCUMENTS

| | | |
|---|---|---|
| EP | 0194834 | 9/1986 |
| WO | 9621216 | 7/1996 |

OTHER PUBLICATIONS http://www.youtube.com/watch?v=uQlbpTzflM0, Steve Meyer, Oct. 29, 2009.
http://www.youtube.com/watch?v=oo1eFkg7pM&feature=relmfu, smileythejazzcat, May 3, 2010.

* cited by examiner

*Primary Examiner* — Kimberly Lockett
(74) *Attorney, Agent, or Firm* — Ryan W. Dupuis; Kyle R. Satterthwaite; Ade & Company Inc.

(57) ABSTRACT

A musical instrument comprising a shell and a rim for tensioning a head across an open end of the shell, for example a drum, is improved by forming one or both of the shell and the rim using a primary material having an axially oriented grain structure together with an auxiliary layer of secondary material having greater hoop strength than the primary material. The primary material can be a natural plant material, such as hardwood with the naturally occurring grain structure being oriented in an axial direction by assembling the annular rim using a stave construction. The secondary material can comprises a composite material including carbon fiber to reinforce the stave construction.

20 Claims, 5 Drawing Sheets

MUSICAL INSTRUMENT WITH A HEAD TENSIONED OVER A SHELL BY A RIM USING AN AXIALLY ORIENTED GRAIN STRUCTURE

This application claims priority benefits under 35 U.S.C. 119(e) from U.S. provisional application Ser. No. 61/451,318, filed Mar. 10, 2011 and U.S. provisional application Ser. No. 61/510,241, filed Jul. 21, 2011.

FIELD OF THE INVENTION

The present invention relates to a musical instrument comprising a shell and a rim for tensioning a head across an open end of the shell, for example a drum, in which one or both of the shell and the rim is formed using a primary material having an axially oriented grain structure, and more particularly the present invention relates to one or both of the shell and the rim having a layer of composite material spanning circumferentially so as to be bonded to one or both of the inner side or outer side or the primary material.

BACKGROUND

Various different constructions of drums are known, which are also known to produce different sounds when the musical instrument is played. A common drum construction comprises a cylindrical shell having an open top end across which a head or skin spans. Typically a peripheral rim provides tension to the head across the open end of the shell.

A similar construction is also known to be applicable to other instruments, for example a banjo.

When forming a rim of wood material, typically several layers of wood are laminated such that the wood grain spans in a generally circumferential direction with the finished construction comprising several plies in the radial direction. U.S. Pat. No. 6,916,977 by Hagiwara and U.S. Pat. No. 7,462,770 by Dunnett disclose two examples of multiple ply wood material in a rim or a hoop for a musical instrument.

US Patent Application Publication 2008/0041215 by Wang describes a natural wood hoop surrounding a metal rim. The metal rim is intended to provide greater strength to withstand a striking action of a drumstick however, the metal is believed to have a negative effect on the natural wood sound of the rim.

A known construction of drum shells includes the use of wooden staves abutted with one another in a circumferential direction in a conventional manner as described in U.S. Pat. No. 2,301,519. The conventional construction of a stave drum shell however typically requires a very large wall thickness in the radial direction to provide sufficient gluing strength between adjacent staves.

SUMMARY OF THE INVENTION

According to one aspect of the invention there is provided a musical instrument comprising:

an annular shell having a peripheral wall extending about an opening at one end of the shell;

a head spanning the opening of the annular shell; and an annular rim engaging the head about a periphery of the opening in the annular shell and being coupled to the annular shell as to be arranged to provide tension to the head spanning the opening of the annular shell;

wherein at least one of the annular shell and the annular rim is an annular member comprising:

a plurality of staves abutted in series in a circumferential direction of the annular member such that each stave extends in an axial direction of the annular member; and an auxiliary layer spanning in the circumferential direction along one side of the staves so as to be bonded to each of the staves;

the staves each comprising a rigid material having a grain structure oriented in the axial direction.

The use of stave construction in a rim, a shell, or both permits the grain of the staves to be oriented in the axial direction to provide a unique and desirable sound from the musical instrument. By further providing an auxiliary or composite layer together with the stave construction, the staves can be provided in a very thin single ply construction. The resulting thin wall construction together with a natural grain oriented in the axial direction in a stave construction in either the rim or the drum shell provides a desirable sounding instrument unfound in the prior art.

According to a second aspect of the present invention there is provided an annular rim for a musical instrument having an annular shell having a peripheral wall extending about an opening at one end of the shell and a head spanning the opening of the annular shell, the annular rim comprising:

an annular member which extends in a circumferential direction about a central axis;

the annular member including an inner portion arranged to engage the head about a periphery of the opening in the annular shell and an outer portion arranged to be coupled to the annular shell as to be arranged to provide tension to the head spanning the opening of the annular shell; and the annular member being formed of a primary material which is rigid and has a grain structure oriented in an axial direction of the central axis.

The annular rim may also comprise a plurality of staves formed of the primary material and which are abutted in series in the circumferential direction of the annular member such that each stave extends in the axial direction.

The annular rim may also further comprise an auxiliary layer formed of a secondary material different than the primary material and spanning in the circumferential direction along one side of the primary material so as to be bonded to the primary material.

Preferably the auxiliary layer provides greater strength in a circumferential direction than the plurality of staves of primary material.

Preferably the auxiliary layer comprises a composite material including a woven fibre material set in a resin.

Preferably the fibre material comprises graphite fibres.

The auxiliary layer may be bonded to an outer side of the staves of primary material, may be bonded to an inner side of the staves of primary material, or may include both a first layer bonded to an outer side of the staves of primary material and a second layer bonded to an inner side of the staves of primary material.

Preferably the staves consist of a natural plant material in which the grain structure comprises a natural grain of the natural plant material, for example a hardwood material, or bamboo.

Alternatively, the rim may be manufactured of any suitable synthetic material having a grain structure which produces a similar acoustic effect as the grain structure of a natural plant material when oriented in the axial direction.

Preferably the staves of primary material have a thickness in a radial direction of the annular member in the range of 1/16 of an inch to 1 inch, or more preferably of approximately 5/8 of an inch according to a first embodiment.

Preferably the ends of the staves of primary material protrude outwardly in the axial direction beyond an end of the auxiliary layer fully about the opening.

When the annular rim has an internal shoulder engaging the head about the periphery of the opening, preferably an end grain of the staves defines the internal shoulder.

The annular rim may include an outer portion extending inward in the axial direction beyond the internal shoulder, the outer portion being formed by the auxiliary layer.

Both the annular shell and the annular rim may comprise the annular member formed of the plurality of staves having the grain structure oriented in the axial direction.

Preferably the staves of primary material comprise a single ply in the radial direction.

In some instances, the auxiliary layer may also comprise a natural plant material which is rigid, but which has a grain oriented in the circumferential direction. In this instance, preferably the annular member further comprises a composite layer spanning in the circumferential direction along one side of either the staves or the auxiliary layer.

The annular rim preferably has an internal end face engaging the head about the periphery of the opening and in which an end grain of the axially oriented grain structure defines the internal end face engaging the head.

In some embodiments, the annular rim may include fastener apertures formed at circumferentially spaced apart positions in the plurality of staves so as to be arranged to receive fasteners therethrough for connection to the shell for tensioning the head.

According to a further aspect of the present invention there is provided a musical instrument comprising:

an annular shell having a peripheral wall extending about an opening at one end of the shell;

a head spanning the opening of the annular shell; and an annular rim engaging the head about a periphery of the opening in the annular shell and being coupled to the annular shell as to be arranged to provide tension to the head spanning the opening of the annular shell;

wherein at least one of the annular shell and the annular rim is an annular member comprising:

a first layer comprising a natural plant material which is rigid; and a composite layer spanning in the circumferential direction along one side of the first layer.

Preferably the first layer has a grain oriented in a circumferential direction and the composite material comprises carbon fibre material.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
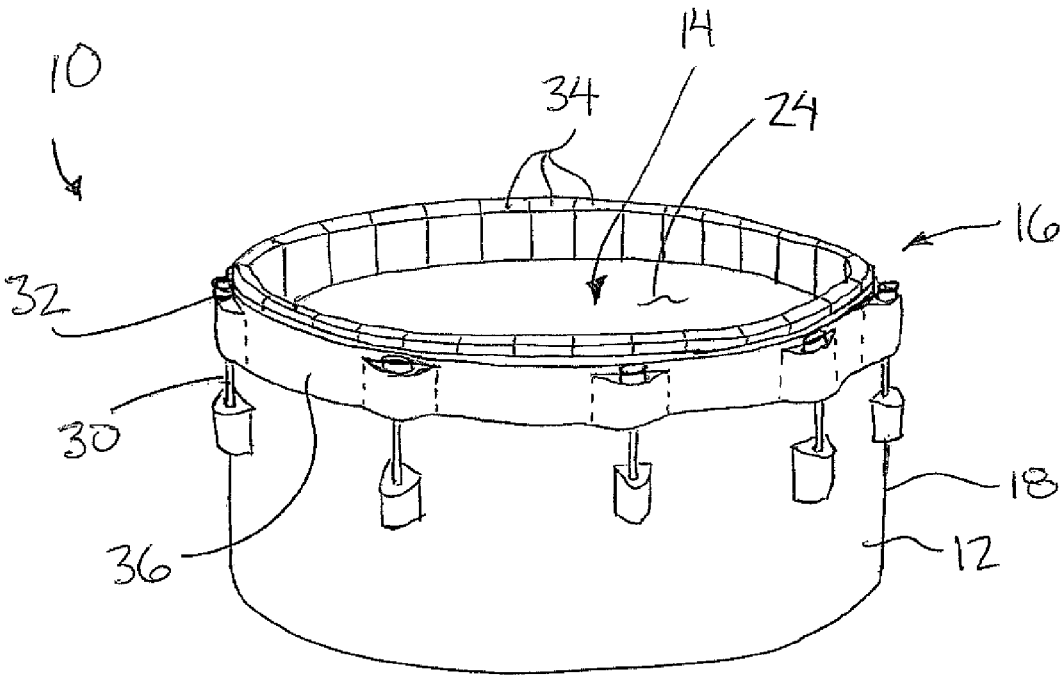
FIG. 1 is a perspective view of a drum according to a first embodiment of the present invention.
Figure 2:
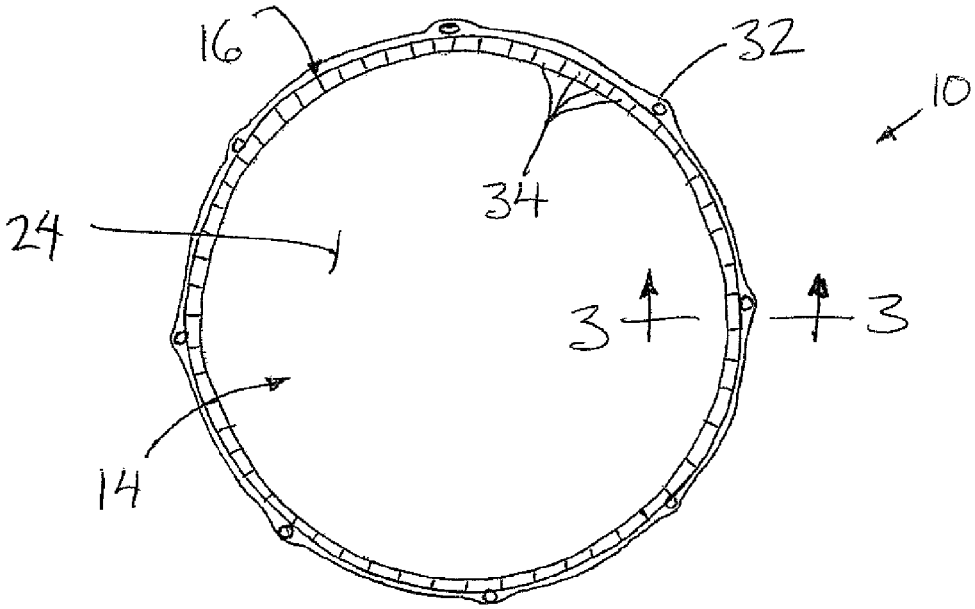
FIG. 2 is a top plan view of the drum according to FIG. 1.
Figure 3:
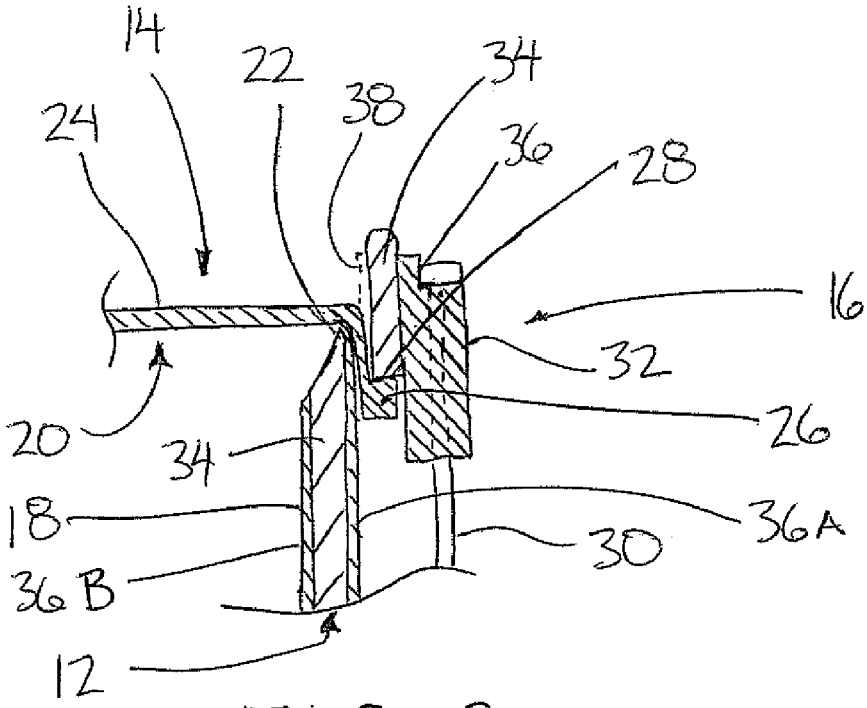
FIG. 3 is a sectional view along the line 3-3 of FIG. 2.
Figure 4:
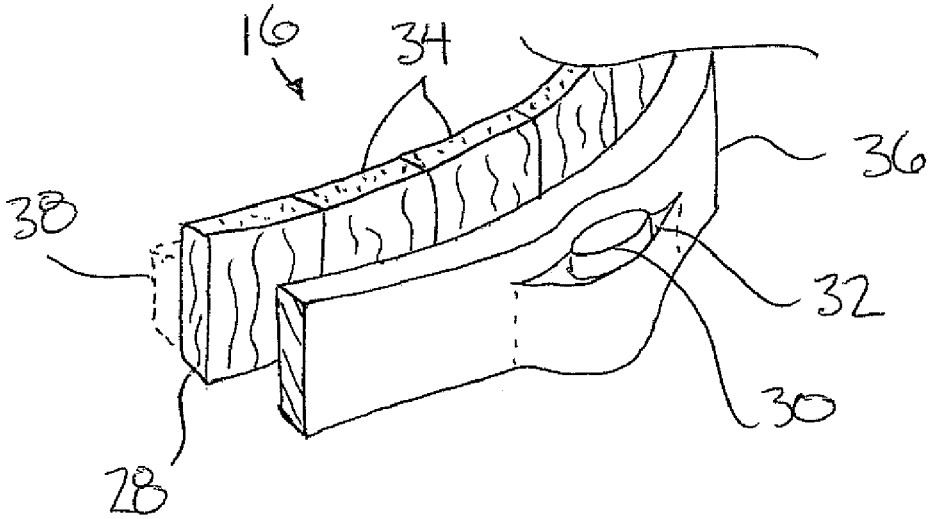
FIG. 4 is a partly sectional perspective view of a portion of the rim according to the first embodiment of FIG. 1.
Figure 5:
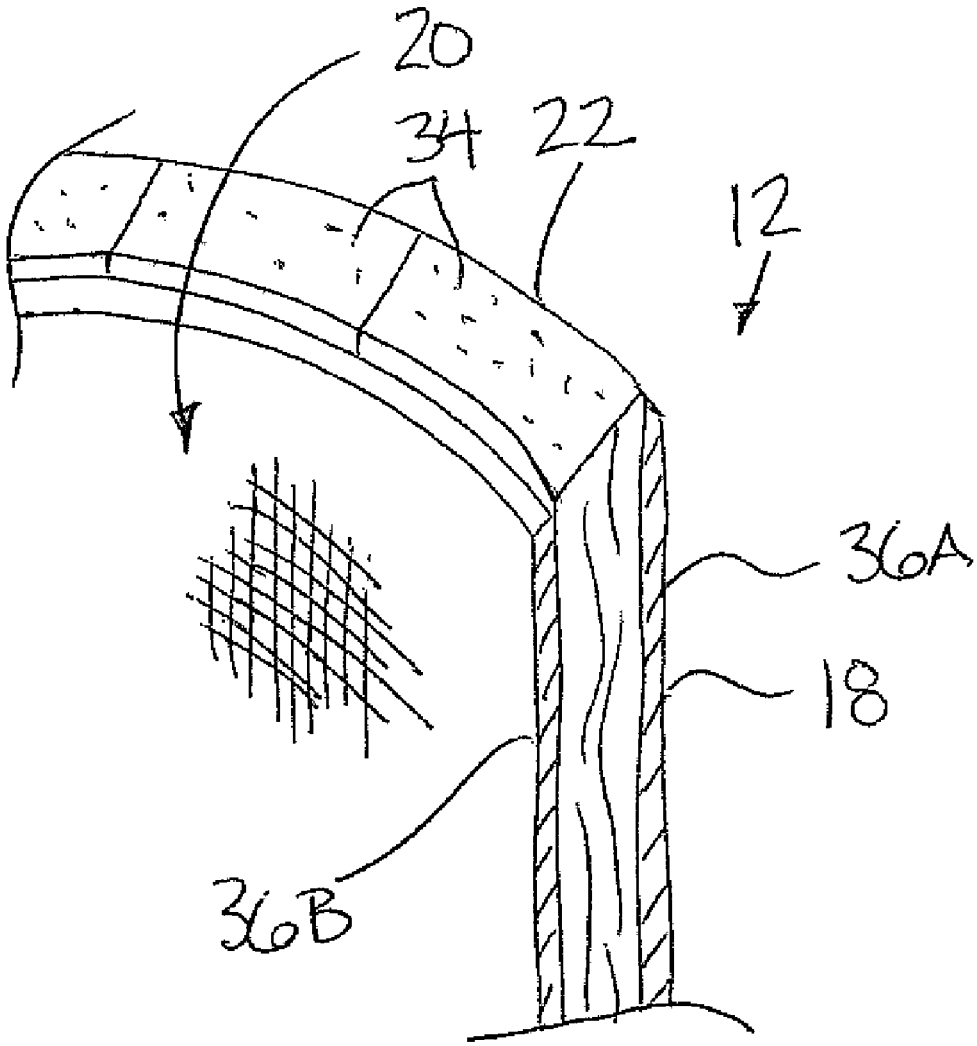
FIG. 5 is a partly sectional perspective view of a portion of the drum shell according to the first embodiment of FIG. 1.

Referring to the accompanying figures, there is illustrated a musical instrument generally indicated by reference numeral 10. More particularly, the instrument according to the illustrated embodiment comprises a drum including an annular shell 12, supporting a drum head 14 thereon using an annular rim 16 or hoop.

As in the typical construction of a drum, the annular shell comprises a peripheral wall which is generally cylindrical about a central axis for surrounding an opening 20 at the top end. The peripheral wall 18 thus extends generally circumferentially about the opening. The top end of the peripheral wall is sloped downwardly and inwardly such that the upper surface is tapered upwardly and outwardly to an outer apex which defines a bearing edge 22 engaging the head 14.

The particular construction of the shell 12 according to the present invention will be described in further detail below.

The head 14 generally comprises a circular skin arranged to span across the opening 20 at the top end of the shell. The head 14 includes a main striking portion 24 having a first thickness, and a retainer ring 26 forming the peripheral edge of the head which has a second thickness greater than the first thickness to form an integral thicker edge to the head. The edge may include an embedded metal ring or other strengthening material incorporated therein. Various conventional types of drum heads 14 can be used with the features of the present invention described in further detail below.

The annual rim 16 is generally circular for engaging the head 14 about the periphery thereof. In particular, the rim 16 is a generally annular cylindrical member having an inner diameter which is close to the outer diameter of the annular shell for receiving a portion of the head 14 therebetween. The rim 16 includes an inner portion defining an inner end face 28 in the form of a shoulder formed on the inner side thereof for overlapping and engaging the retainer ring 26 about the periphery of the head about the full circumference of the opening in the shell.

A plurality of fasteners 30 are coupled between the annular rim 16 and the annular shell 12 to pull the rim inwardly in the axial direction relative to the shell so as to provide radial tension to the striking portion of the drum head 14 spanning across the opening. The rim 16 includes a plurality of fastener anchors 32 at circumferentially spaced positions thereabout in the form of axially extending bores extending between a shoulder at the top or outer side of the rim and an opposing bottom surface to receive respective ones of the fasteners 30 therethrough. The fasteners 30 are thus anchored to the annular rim 16 by the fastener anchors 32 to clamp the head over the opening in the shell.

The construction of the rim and the shell in the first embodiment of FIGS. 1 through 5 is similar in many aspects as described herein. Each of the rim and the shell comprises an annular member formed of a plurality of staves 34 which are abutted with one another in a circumferential direction about the opening 20. The staves are each formed of a natural plant material which is rigid and which has a natural grain orientation such as wood or bamboo for example. In each instance, the natural grain of the staves is oriented in the axial direction of the staves such that axially opposed inner and outer ends of the annular member locate the end grain of the material. The staves are assembled to form the annular member such that the entire layer formed by the staves 34 is a single ply or single layer in the radial direction.

Each annular member further comprises an auxiliary layer 36 in the form of a composite layer comprising a woven fibre material, for example fibreglass or more preferably graphite cloth, which is set in a suitable curable resin, for example epoxy.

In the construction of the rim 16, the layer formed of staves abutted in the circumferential direction define the inner shoulder 28 such that the surface of the shoulder oriented perpendicularly to the axial direction which abuts the retainer ring 26 of the head locates an end grain of the stave material.

The stave layer is arranged relative to the composite layer 36 such that the top or outer end of the stave layer extends axially outward beyond the corresponding top edge of the composite layer. In this manner, the portion of stave material projecting beyond the composite layer by itself defines the exposed striking portion of the rim.

The single ply of staves in the radial direction typically have a thickness in the range of $1/16^{th}$ of an inch to 1 inch. Typically this corresponds to a stave layer which is thicker in the radial direction than an upper portion of the composite layer.

In the first embodiment when the anchors 32 are located in an outermost auxiliary layer 36, the stave layer has a thickness in the radial direction of approximately $1/8^{th}$ of an inch with the composite layer typically being thicker to provide adequate strength.

In the instance of the annular rim 16, the composite layer 36 surrounds the outer side of the stave layer so as to fully surround the stave layer in the circumferential direction. In the axial direction, the composite layer typically projects inwardly beyond the inner shoulder 28 defined by the bottom end of the staves in the illustrated embodiment. This lower portion of the composite layer can be formed much thicker at the fastener anchors 32 for locating the bores therein which receive the fasteners 30. The remaining portion of the composite layer can be much thinner so as to be closer in thickness in the radial direction to the thickness of the staves.

In further embodiments of the rim, an auxiliary layer 38, for example a composite layer, may be provided along the inner side of the stave layer in addition to or instead of the first layer 36. In this instance the inner composite layer 38 is typically shorter in the axial direction than the staves such that the material forming the staves projects in the axial direction outward beyond the top end of the inner composite layer similar to the outer composite layer to define the striking portion of the rim being formed only of the natural material of the staves. At the inner end, the inner composite layer 38 may terminate at the inner shoulder 28, or alternatively the staves may similarly project axially inward beyond the inner end of the inner composite layer such that only the end grain of the staves engage the retainer ring 26 of the head in the mounted position.

In the instance of the shell, the stave layer of the annular member typically spans a majority of the radial thickness such that the material of the staves defines the sloped profile of the top edge and the resulting bearing edge 22 of the shell which supports the head thereon. In the illustrated embodiment, the composite layer 36 comprises a first layer 36A fully spanning the outer side of the stave layer about the full circumference in addition to a second composite layer 36B which lines and fully spans the inner side of the stave layer. The stave layer typically projects axially outward beyond the top edges of the first and second composite layers such that the stave material defines the bearing edge comprising an end grain of the stave material in the illustrated embodiment.

The construction of the present invention results in a new natural sound to the musical instrument created by using the combination of axially oriented stave construction with the composite wrap layers using either fibreglass, Kevlar or graphite cloth with resins. The stave construction of a rim allows the sound waves that are created when the drumstick hits the drum skin or drum rim to travel directly through the vertical natural grains onto the drum skin causing the majority of the sound wave energy to resonate through the drum. This creates a new sound to the drum in the application of either hitting the skin or when hitting a rim for a rim shot. The resulting sound is found to be a unique natural sound that is greatly desired. Various species of wood or other natural grain material can be used to create different sounds, but preferably hardwood is used.

As described herein, the drums and hoops are unique because both use thin walled naturally grained material for stave construction and a composite layer combined such that the staves are wrapped in a layer of carbon fibre. The attributes are as follows: i) graphite gives the drums/rims more projection due to the minimal sound wave alteration effect of it's transmission properties i.e. graphite has a low absorption rate of vibration energy from sound waves; ii) graphite gives thin walled stave drums and hoops strength and rigidity; and iii) thin walled stave construction transmits sound waves faster and that are less altered due to the direct exit route of the sound wave traveling straight down the end grain unlike cross grain construction where glue dampens wood vibrations. Accordingly stave construction in accordance with the present invention produces better sound transmission in both drums and hoops.

In the instance of rims, the ply hoop is currently the most common form of hoop produced in which the wood is on edge on the crosswise wood grain. Constant drumstick strikes make this prior art ply construction hoop susceptible to undesirable wear. As an exemplary comparison, a 6" ply rim hoop can require 300 sq ft of surface area to be glued, whereas a similar 6" hardwood stave hoop can require only 5 sq inches of surface area to be glued. The sound waves acoustic frequency along the cross grain direction using the oak species of wood is 4000 hertz while the end grain frequency is reduced to 2500 hertz. In this case the compressive sound wave of a strike from a drum stick will travel nearly twice as fast with the grain (stave hoops) as opposed to the cross grain (ply hoops).

Figure 6:
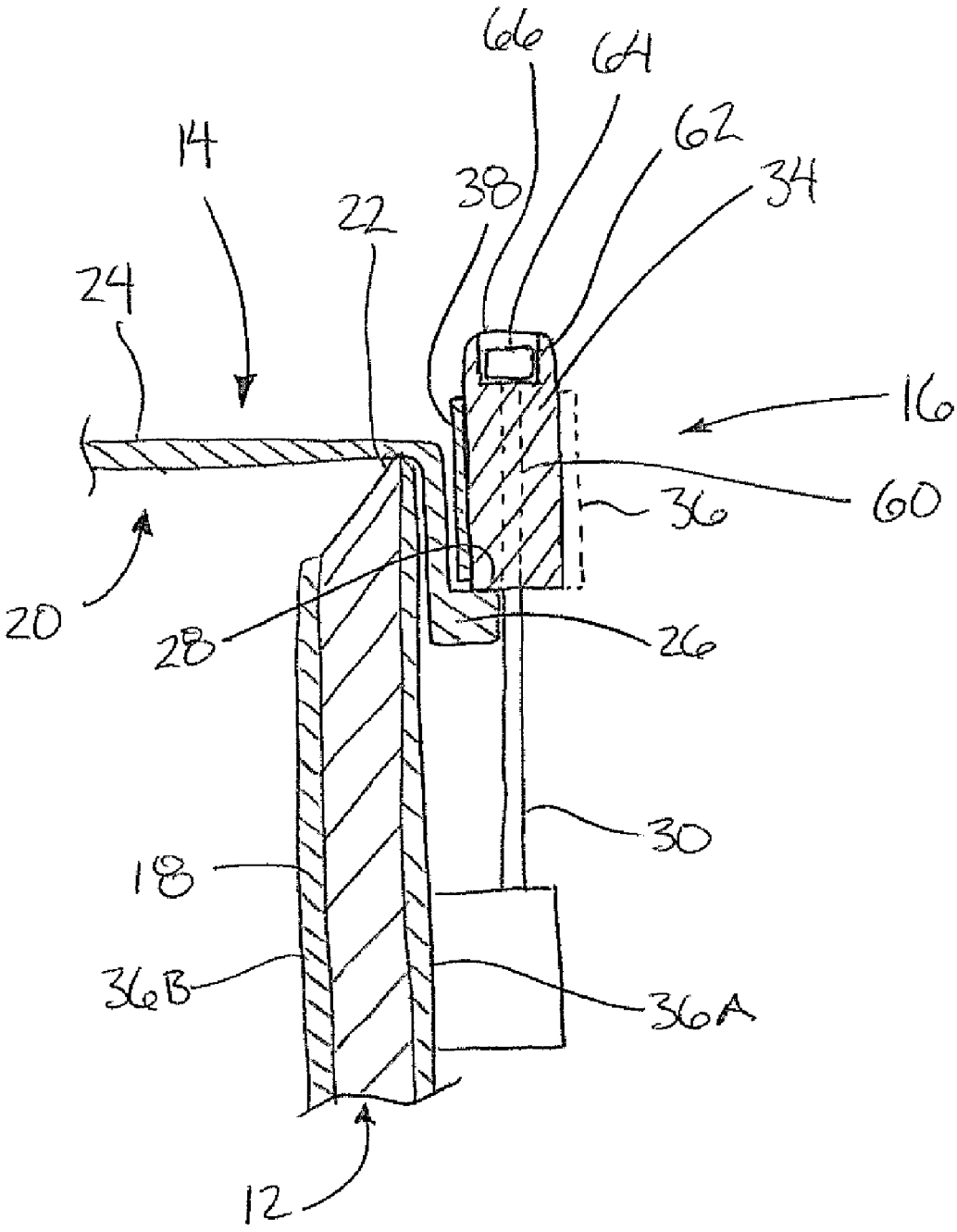
FIG. 6 is a sectional view similar to FIG. 3 of a second embodiment of the drum according to the present invention.

Turning now to FIG. 6, according to a further embodiment, the shell 12 can be arranged similarly to previous embodiments, but the rim 16 in this instance instead locates the fastener anchors 32 in the primary material of the stave layer 34. Accordingly no auxiliary layer 36 is required on the outer side of the rim to form the anchors 32 such that the outer auxiliary layer 36 is optional in this instance. Due to the possibility of a lack of strength resulting from the grain orientation in the axial direction, the auxiliary layer 38 on the inner side of the rim remains. The inner auxiliary layer 38 is of a secondary material having a greater strength than the primary material in the circumferential direction of the rim.

The anchors 32 in the embodiment of FIG. 6 comprise bores 60 extending axially through the primary material at circumferentially spaced apart positions for alignment with corresponding fastener anchors on the shell. The bores receive the fasteners slidably therethrough. A larger diameter counter bore 62 is provided at the top end such that a head 64 of each fastener is recessed relative to the upper striking edge 66 of the primary material layer 34. To accommodate for the bores 60, the primary material layer in this instance has a thickness in the radial direction of approximately $5/8^{th}$ of an inch with the composite layer typically being thinner while still providing adequate strength.

As in the previous embodiment, the primary material layer 34 in FIG. 6 again includes an inner end face 28 which defines an inner portion of the rim for abutting the retainer ring 26 of the head 14. The bores 60 are located in a remaining outer portion of the rim extending radially outward from the inner portion that engages the retainer ring of the head.

In preferred embodiments, the primary material layer 34 consists of a natural plant material, for example a hardwood or bamboo, having a naturally occurring grain structure which is oriented in the axial direction of the rim by use of a stave construction. The secondary material of the inner auxiliary layer 38 in the preferred embodiment comprises a composite material including woven fibres set in a curable resin material for strength. Alternatively, the secondary material may comprise any suitable plastic material which can provide strength in the circumferential direction to the axially oriented grain structure of the primary material.

Typically in the embodiments described above, the inner or outer auxiliary layer(s) 36 and/or 38, typically of composite material, provide greater strength in the circumferential direction than the plurality of staves of the stave layer 34. In yet further embodiments however, the stave layer 34 may comprise any suitable primary material, natural or synthetic, having a grain structure, which is natural or synthetic, and which is oriented in the axial direction to produce the desirable acoustic effect of the present invention. In some instances, particularly for synthetic materials, the primary material layer 34 may not require a stave construction and thus no additional auxiliary layer 36 or 38 would be required to provide sufficient strength in the circumferential direction.

Figure 7:
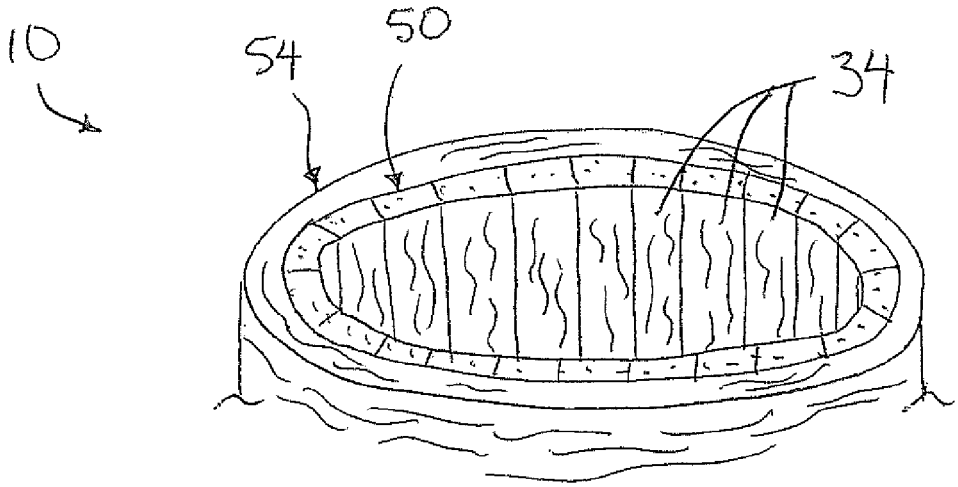
FIG. 7 is a perspective view of a further embodiment of the annular member.

Turning now to FIG. 7, a further embodiment of the annular member for use as a rim or a shell will now be described. In this instance, the annular member includes a first layer 50 formed of staves 34 as described above. A second layer 52 in this instance comprises another layer of rigid natural plant material, for example wood, which is formed in plies oriented in the circumferential direction about an outer side of the first layer of staves such that the grain is oriented in the circumferential direction to reinforce the stave layer. This construction makes use of the advantages of the stave construction noted above, but with a different sound quality than when using a composite layer to reinforce the stave construction.

In further arrangements, the second layer of wood plies may span the inner side of the staves. Furthermore, the first and second wood layers may also be wrapped by an additional composite layer 36 of carbon fibre or graphite material set in a suitable epoxy matrix which lines either one of or both of the inner and outer sides of the first and second wood layers.

Figure 8:
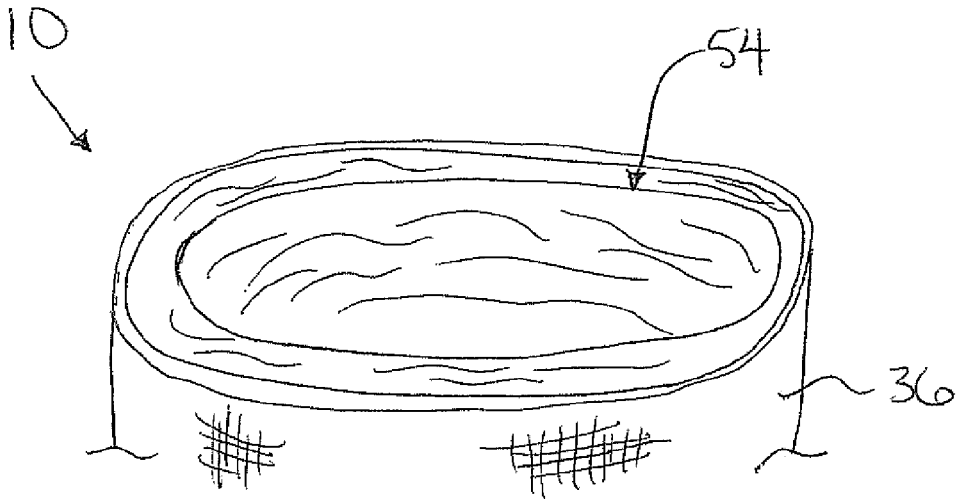
FIG. 8 is a perspective view of yet another embodiment of the annular member.

Turning now to FIG. 8, another embodiment of the annular member for use as a rim or a shell will now be described. In this instance a first layer 54 of rigid natural plant material, for example wood, is formed in plies oriented in the circumferential direction such that the grain is oriented in the circumferential direction, or in other angular orientations for example. An additional composite layer 36 of carbon fibre or graphite material set in a suitable epoxy matrix is then provided about either one or both of the inner and outer sides of the first layer 54. The process of applying graphite helps make the drum sound brighter and creates strength and durability.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A musical instrument comprising:

an annular shell having a peripheral wall extending about an opening at one end of the shell;

a head spanning the opening of the annular shell; and an annular rim engaging the head about a periphery of the opening in the annular shell and being coupled to the annular shell as to be arranged to provide tension to the head spanning the opening of the annular shell;

wherein at least one of the annular shell and the annular rim is an annular member comprising:

a plurality of staves abutted in series in a circumferential direction of the annular member such that each stave extends in an axial direction of the annular member; and an auxiliary layer spanning in the circumferential direction along one side of the staves so as to be bonded to each of the staves;

the staves each comprising a rigid material having a grain structure oriented in the axial direction.

2. The musical instrument according to claim 1 wherein the auxiliary layer provides greater strength in a circumferential direction than the plurality of staves.

3. The musical instrument according to claim 1 wherein the auxiliary layer comprises a composite material including a woven fibre material set in a resin.

4. The musical instrument according to claim 3 wherein the fibre material comprises graphite fibres.

5. The musical instrument according to claim 1 wherein the auxiliary layer is bonded to an outer side of the staves.

6. The musical instrument according to claim 1 wherein the auxiliary layer is bonded to an inner side of the staves.

7. The musical instrument according to claim 1 wherein the auxiliary layer comprises a first layer bonded to an outer side of the staves and a second layer bonded to an inner side of the staves.

8. The musical instrument according to claim 1 wherein the staves consist of a natural plant material in which the grain structure comprises a natural grain of the natural plant material.

9. The musical instrument according to claim 1 wherein an end of the staves about the opening protrude outwardly in the axial direction beyond an end of the auxiliary layer about the opening.

10. The musical instrument according to claim 1 wherein the annular rim comprises the annular member formed of the plurality of staves having the grain structure oriented in the axial direction.

11. The musical instrument according to claim 1 wherein the staves comprise a single ply in the radial direction.

12. An annular rim for a musical instrument having an annular shell having a peripheral wall extending about an opening at one end of the shell and a head spanning the opening of the annular shell, the annular rim comprising:

an annular member which extends in a circumferential direction about a central axis;

the annular member including an inner portion arranged to engage the head about a periphery of the opening in the annular shell and an outer portion arranged to be coupled to the annular shell as to be arranged to provide tension to the head spanning the opening of the annular shell; and the annular member being formed of a primary material which is rigid and has a grain structure oriented in an axial direction of the central axis.

13. The annular rim according to claim 12 wherein the annular member further comprises an auxiliary layer formed of a secondary material different than the primary material and spanning in the circumferential direction along one side of the primary material so as to be bonded to the primary material.

14. The annular rim according to claim 12 wherein the auxiliary layer provides greater strength in a circumferential direction than the plurality of staves.

15. The annular rim according to claim 12 wherein the auxiliary layer comprises a composite material including a woven fibre material set in a resin.

16. The annular rim according to claim 12 wherein the primary material consists of a natural plant material in which the grain structure comprises a natural grain of the natural plant material.

17. The annular rim according to claim 12 wherein the primary material protrudes outwardly in the axial direction beyond an end of the auxiliary layer fully about the opening.

18. The annular rim according to claim 12 wherein the annular rim has an internal end face engaging the head about the periphery of the opening and wherein an end grain of the primary material defines the internal end face engaging the head.

19. The annular rim according to claim 12 wherein the annular rim includes fastener apertures formed at circumferentially spaced apart positions in the primary material so as to be arranged to receive fasteners therethrough for connection to the shell for tensioning the head.

20. A musical instrument comprising:

an annular shell having a peripheral wall extending about an opening at one end of the shell;

a head spanning the opening of the annular shell; and an annular rim engaging the head about a periphery of the opening in the annular shell and being coupled to the annular shell as to be arranged to provide tension to the head spanning the opening of the annular shell;

wherein at least one of the annular shell and the annular rim is an annular member comprising:

a first layer comprising a natural plant material which is rigid; and a composite layer spanning in the circumferential direction along one side of the first layer.

* * * * *